US009873598B2

(12) United States Patent
Radmall

(10) Patent No.: US 9,873,598 B2
(45) Date of Patent: Jan. 23, 2018

(54) DAVIT WITH MULTI-TOOL ATTACHMENT

(75) Inventor: Paul Radmall, Malborough (NZ)

(73) Assignee: REID LIFTING LIMITED, Chepstow, Monmouthshire (GB)

( * ) Notice: Subject to any disclaimer, the term of this patent is extended or adjusted under 35 U.S.C. 154(b) by 675 days.

(21) Appl. No.: 12/954,750

(22) Filed: Nov. 26, 2010

(65) Prior Publication Data

US 2011/0132859 A1 Jun. 9, 2011

(30) Foreign Application Priority Data

Nov. 27, 2009 (GB) ..... 0920758.0

(51) Int. Cl.

| | |
|---|---|
| ***B66C 23/48*** | (2006.01) |
| ***A61G 7/10*** | (2006.01) |
| ***B66C 23/16*** | (2006.01) |
| ***B66C 23/62*** | (2006.01) |

(52) U.S. Cl.

CPC ..... *B66C 23/48* (2013.01); *A61G 7/1017* (2013.01); *B66C 23/16* (2013.01); *B66C 23/62* (2013.01)

(58) Field of Classification Search

CPC ..... B66C 23/54; B66C 23/166; B66C 23/62; B66C 23/48; B66C 23/16; A61G 7/1017

USPC ..... 212/175, 179, 180, 294, 299, 300, 255, 212/258, 260–261, 347; 5/85.1, 87.1; 414/543, 542, 560, 561, 562, 563

See application file for complete search history.

(56) References Cited

U.S. PATENT DOCUMENTS

| | | | | |
|---|---|---|---|---|
| 1,471,971 | A | 10/1923 | Miller | |
| 2,615,584 | A * | 10/1952 | Adams | 212/294 |
| 2,675,209 | A * | 4/1954 | Freed | 254/2 R |
| 3,358,849 | A | 12/1967 | Becker | |
| 5,752,799 | A * | 5/1998 | Carey | B60P 1/5471 224/403 |
| 5,791,858 | A * | 8/1998 | Sasser | A22B 5/161 414/462 |
| 6,089,431 | A * | 7/2000 | Heyworth | 224/521 |
| 6,189,866 | B1 * | 2/2001 | Harkins et al. | 254/332 |
| 6,425,727 | B1 * | 7/2002 | Hood | 414/543 |
| 6,981,834 | B1 * | 1/2006 | Henry | 414/462 |
| 2002/0066710 | A1 * | 6/2002 | Spitsbergen | 212/179 |
| 2006/0169661 | A1 * | 8/2006 | Brossart et al. | 212/241 |

FOREIGN PATENT DOCUMENTS

| | | |
|---|---|---|
| DE | 1232716 | 7/1967 |

OTHER PUBLICATIONS

United Kingdom Search Report dated Mar. 22, 2010.

* cited by examiner

*Primary Examiner* — Michael R Mansen
*Assistant Examiner* — Nathaniel L Adams
(74) *Attorney, Agent, or Firm* — Fitch Even Tabin & Flannery, LLP

(57) ABSTRACT

A davit comprising a column which is mountable for rotation about a generally upright axis and a jib, the jib being attached to the column, characterised in that the column is provided, on a first side thereof, with ribs defining a first channel.

8 Claims, 8 Drawing Sheets

DAVIT WITH MULTI-TOOL ATTACHMENT

CROSS REFERENCE To RELATED APPLICATION

This application claims the benefit of Great Britain Application No. 0920758.0, filed on Nov. 27, 2009, which is hereby incorporated by reference herein.

TECHNICAL FIELD

The present invention relates to a davit, and to a column for a davit.

BACKGROUND

A davit is a lifting tool which comprises a generally upright column and a jib attached to the column, with the column being mounted for rotation about an axis thereof A lifting tool such as a chain block is provided at a distal end of the jib to permit a load to be lifted. Once the load has been lifted the davit can be rotated about the axis of the column and the load can be lowered, using the lifting tool, and dropped in a new location within the arc of rotation of the davit. Davits are used in a diverse range of lifting applications, including applications in the water treatment industry such as lifting and moving heavy pumps and mixers, and medical applications such as lifting bedridden patients to move them onto trolleys in hospitals.

Existing davits suffer from a number of disadvantages. For heavy duty applications a davit, and in particular the column, must be strong and resistant to bending forces which are applied during lifting of a load. In order to impart the required strength to the davit heavy materials must be used, which reduces the portability of the davit. Additionally, most davits are designed for a specific purpose and cannot easily be adapted for another application. This leads to unnecessary expense, as separate davits must be acquired for different applications.

SUMMARY

According to a first aspect there is provided a davit comprising a column which is mountable for rotation about a generally upright axis and a jib, the jib being attached to the column, characterised in that the column is provided, on a first side thereof, with ribs defining a first channel.

The davit provides a lightweight and versatile solution which is suitable for use in a wide variety of lifting applications. The ribs of the column add rigidity to the column, whilst the first channel defined by the columns provides an easy, quick and safe mounting for tools and other equipment, such that a davit can easily and quickly be configured with the correct equipment to suit a particular application.

The column may be provided, on a second side thereof, with further ribs defining a second channel.

The second side may be an opposed side to the first side.

The column may be provided with one or more attachment formations by means of which a tool or other equipment may be attached to the first side of the column.

For example, one or both of the ribs of the first side of the column may be provided with one or more mounting holes for receiving attachment members for attaching a tool or other equipment to the ribs of the first side of the column.

Similarly, the column may be provided with one or more attachment formations by means of which a tool or other equipment may be attached to the second side of the column.

For example, one or both of the ribs of the second side of the column may be provided with one or more mounting holes for receiving attachment members for attaching a tool or other equipment to the ribs of the second side of the column.

The jib may be pivotally attached to the column.

Alternatively, the jib may be fixedly attached to the column.

The column may be hollow.

The column may further comprise a bearing.

The column may be of aluminium.

The ribs may be integral with the column.

According to a second aspect there is provided a column for a davit according to the first aspect.

BRIEF DESCRIPTION OF THE DRAWINGS

Embodiments will now be described, strictly by way of example only, with reference to the accompanying drawings, of which.

DESCRIPTION OF THE PREFERRED EMBODIMENTS

Figure 1:
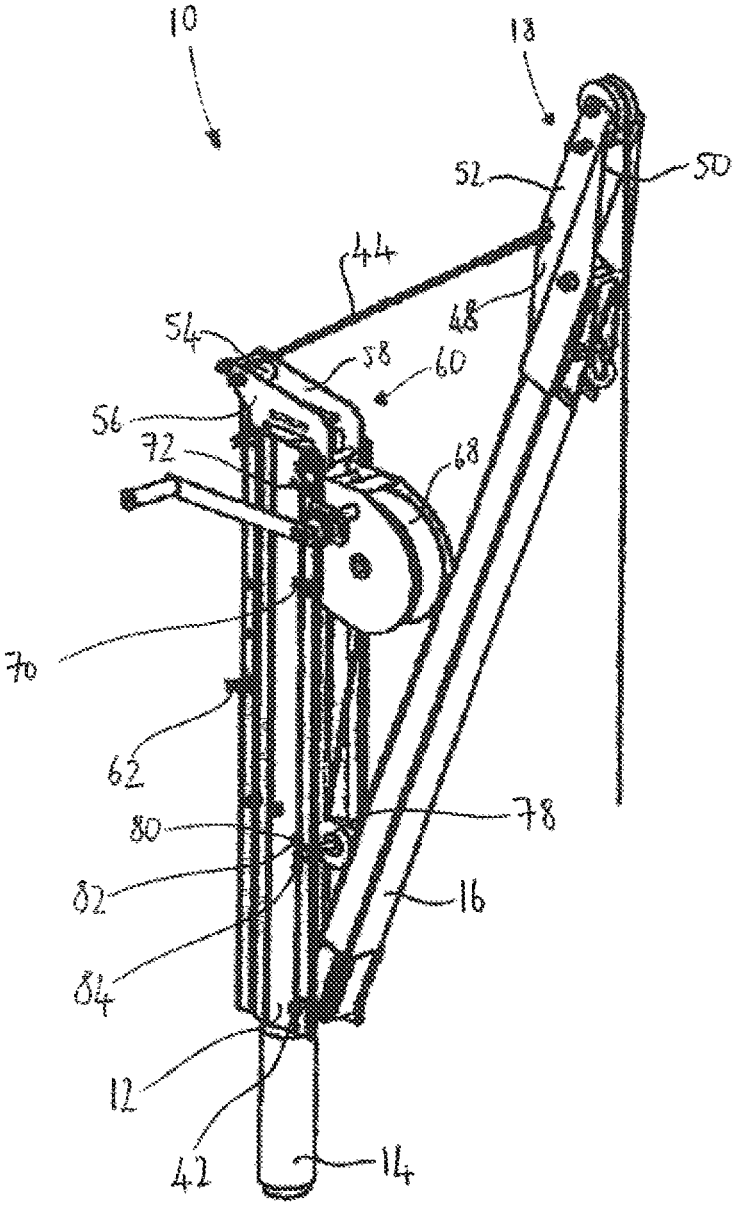
FIG. 1 is a perspective view of an exemplary davit.
Figure 2:
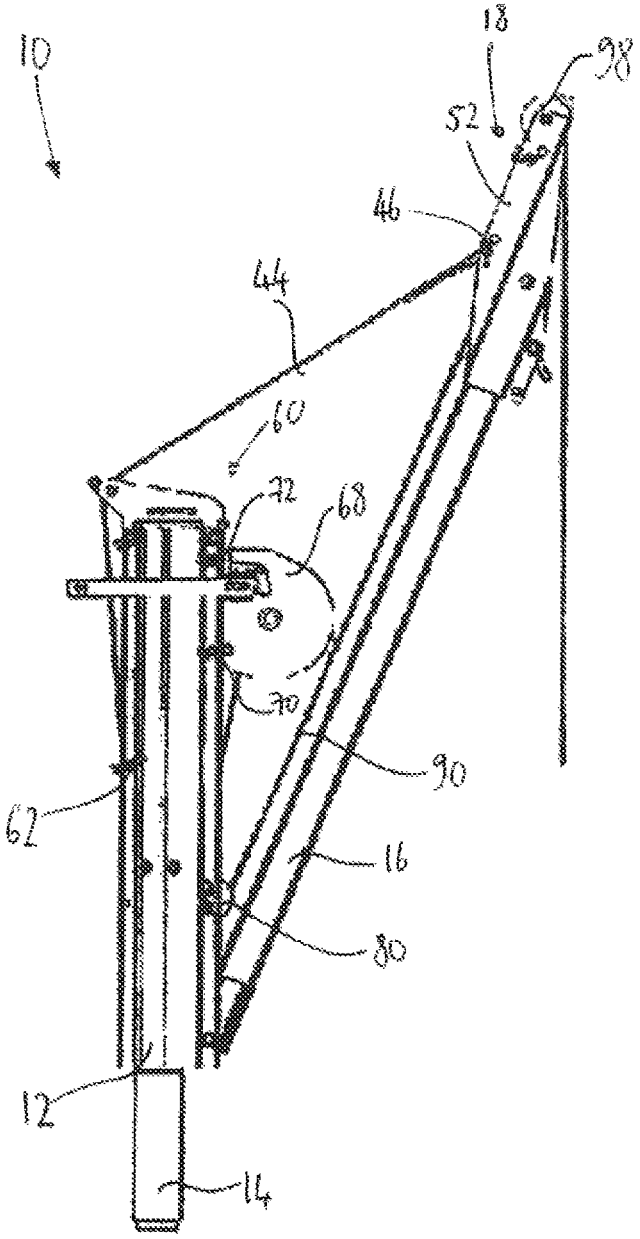
FIG. 2 is a view showing one side of the davit shown in FIG. 1.

Referring first to FIGS. 1 and 2, a davit is shown generally at 10, and comprises a column 12 which is mounted on a king post 14 for rotation about a generally upright axis. A jib 16 is pivotally attached to the column 12, and supports, towards a distal end thereof, a pulley system 18.

Figure 3:
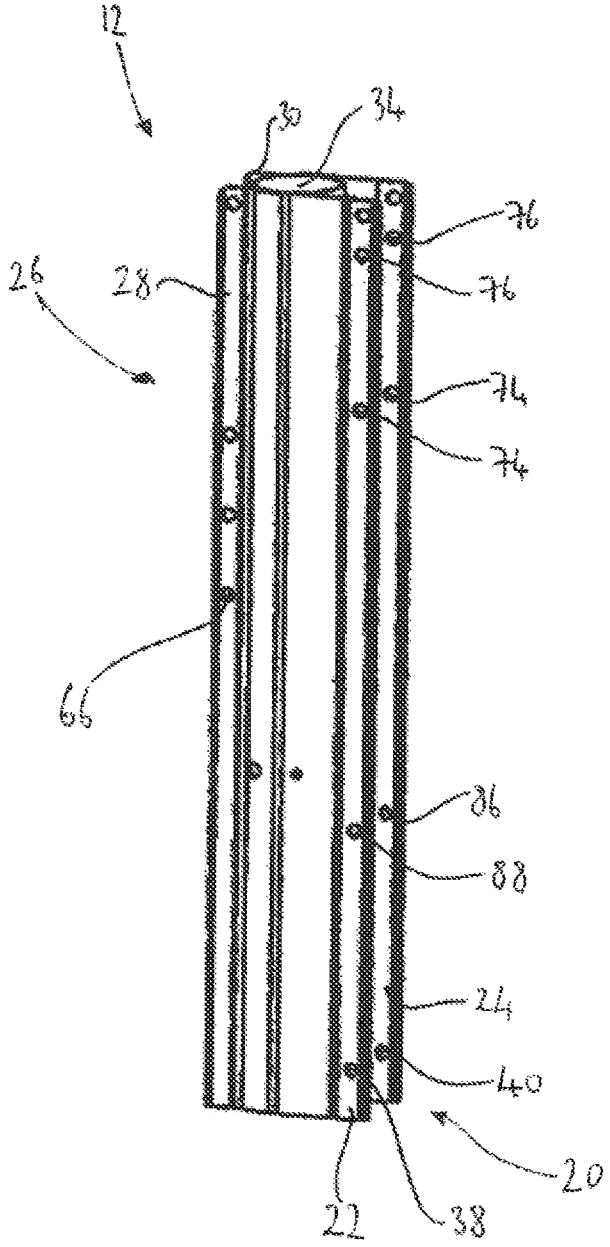
FIG. 3 is a perspective view of a column of the davit of FIGS. 1 and 2.
Figure 4:
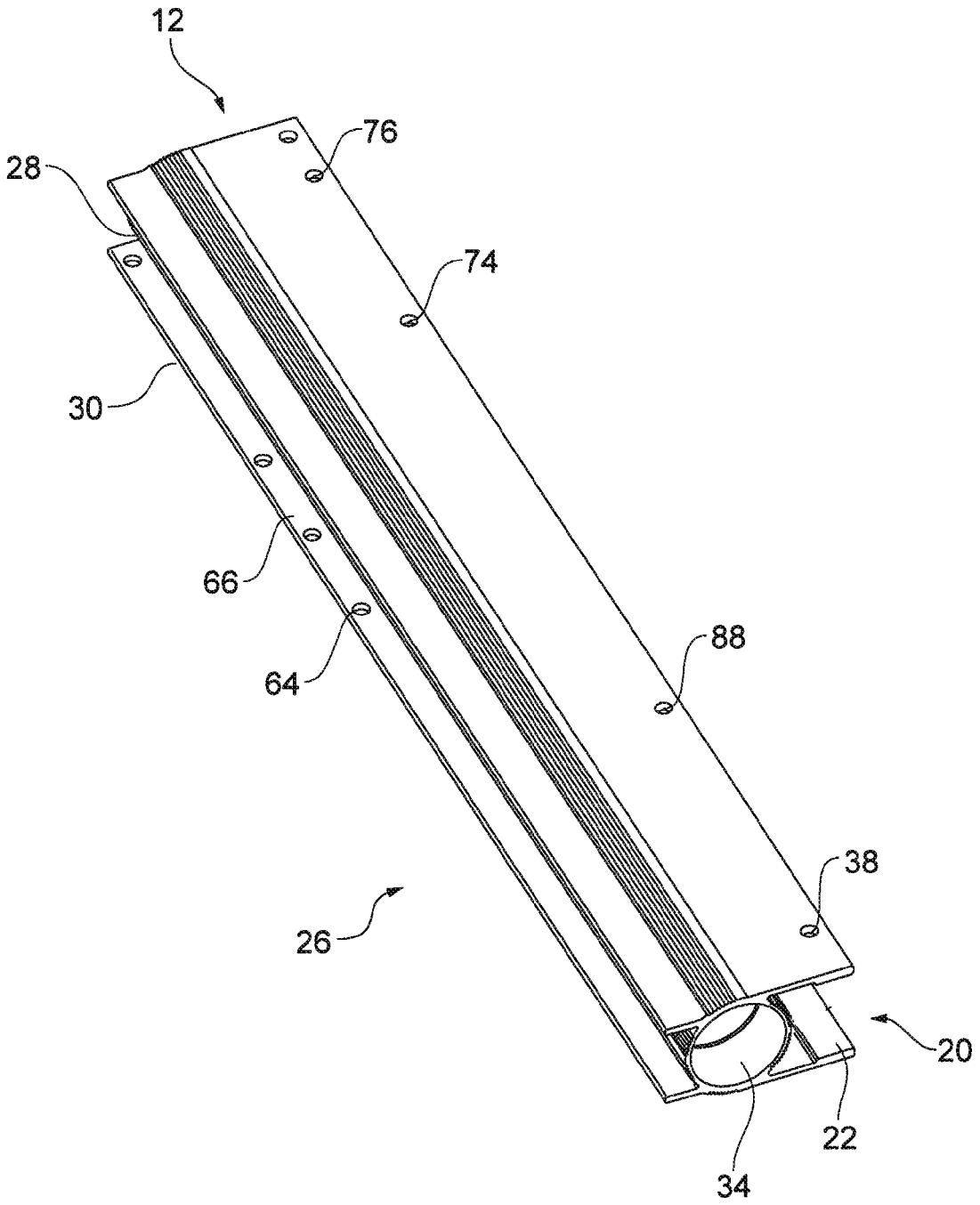
FIG. 4 is a further perspective view of the column shown in FIGS. 1 and 2.
Figure 5:
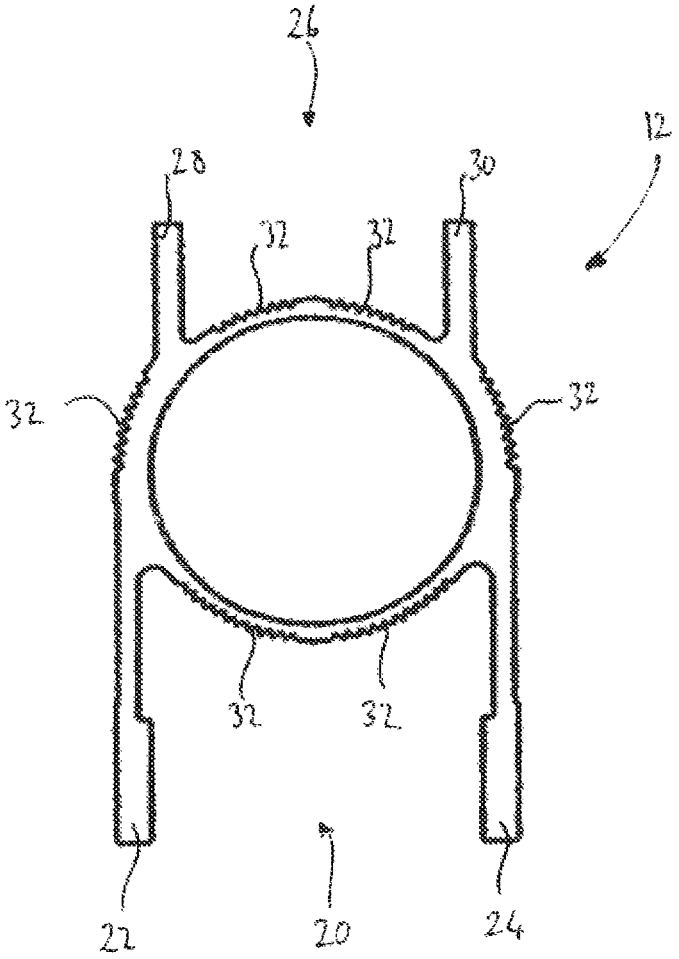
FIG. 5 is a view showing a cross-section of the column shown in FIGS. 3 and 4.

FIGS. 3 and 4 are perspective views showing the column 12, whilst FIG. 5 is a view showing a cross-section of the column 12. It can be seen from FIGS. 3, 4 and 5 that the column 12 is provided, on a front side 20 thereof, with a pair of generally parallel ribs 22, 24 which extend outwardly of the front side 20 of the column 12 so as to define a first channel therebetween. The ribs 22, 24, extend along substantially the entire length of front side 20 of the column 12.

A rear side 26 of the column 12 is provided with a further pair of generally parallel ribs 28, 30, which extend outwardly of the rear side 26 of the column 12 to define a second channel therebetween. The further pair of ribs 28, 30 extend along substantially the entire length of the rear side 26 of the column 12.

In this example the column 12 is formed as a unitary body of extruded aluminium, with the ribs 22, 24, 28, 30 being integral with the column 12. Aluminium is a particularly suitable material for the column 12 as it is lightweight and strong, and lends itself to forming by extrusion, allowing the column 12 to be formed as a unitary body with integral ribs 22, 24, 28, 30 and knurled sections 32 which facilitate handling of the davit 10 by improving a user's grip on the column 12. The lightweight nature of the column 12 allows the davit 10 to be portable, in that it can be lifted and carried by a single person. Nevertheless, it will be appreciated that other materials could be used to form the column 12. For example, the column 12 could be manufactured from steel, with the ribs 22, 24, 28, 30 being welded or otherwise attached to the front and rear sides 20, 26 of the column 12.

As will be clear from FIGS. 3, 4 and 5, the column 12 is hollow, having a generally cylindrical bore 34 extending therethrough. By manufacturing the column 12 as a hollow body in this way the overall weight of the davit 10 can be minimised without materially affecting the strength of the column 12. The bore 34 is configured to receive a rotary bearing (such as that described in the applicant's UK patent no. GB2408038). The bearing in turn receives the king post 14 such that the davit 10 can be mounted for rotation about an axis of the king post 14, which is generally upright in use of the davit 10.

The ribs 22, 24, 28, 30 serve two purposes. The first is to permit tools, retaining pins or other equipment to be mounted on the column 12, as will be described in more detail below. The second purpose of the ribs 22, 24, 28, 30 is to strengthen the column 12 and to provide it with additional rigidity and resistance to bending forces.

The jib 16 is pivotally attached to the front side 20 of the column 12 by means of an axle 36 which is mounted between the rib 22, 24. The axle 36 is received in mounting holes 38, 40 on the ribs 22, 24, and passes through mounting holes located towards one end of the jib 16, thus attaching the jib 16 to the column 12 whilst still permitting rotation of the jib 16 around the axle 36. The mounting holes of the jib 16 may be provided with bearings to reduce friction between the axle 36 and the mounting holes so as to facilitate rotation of the jib 16 about the axle 36. The axle is provided with end caps 42 which are secured to the free ends of the axle 36 to prevent the axle 36 from accidentally becoming disengaged from the mounting holes 38, 40 in the ribs 22, 24. The end caps 42 in ay be fixed, or may be removable to permit the position of the jib 16 on the column 12 to be adjusted. In the example shown in FIG. 1 the axle 36 is positioned towards a lower end of the column 12, but it will be appreciated that the jib 16 could be positioned elsewhere on the column 12 if required.

The jib 16 is restrained by a restraining strap 44 which is attached to a pin 46 which extends between opposed sides 48, 50 of a frame 52 of the pulley system 18 mounted at the distal end of the jib 16. The restraining strap 44 passes over a strap spool 54 mounted between opposed sides 56, 58 of a frame unit 60 mounted at an upper end of the column 12, and is anchored to the rear side 26 of the column 12 by a pin 62 which is received in mounting holes 64, 66 in the ribs 28, 30. The ribs 28, 30 are provided with a plurality of pairs of mounting holes at different positions along their length to provide alternative mounting positions for the pin 62. In this way, the angle of the jib 16 with respect to the column 12 can be adjusted to suit particular applications of the davit 10.

In the exemplary davit 10 shown in FIG. 1 a winch 68 is mounted in the first channel between the ribs 22, 24 of the front side 20 of the column 12, towards an upper end of the column 12. The winch 68 is attached to the ribs 22, 24 by means of attachment members which in this example are bolts 70, 72 which pass through mounting holes 74, 76 in the ribs 22, 24. It will be appreciated however that any convenient attachment member may be used. For example, the winch 68 may be attached to the ribs 22, 24 by means of hook formations on the ribs 22, 24, or by rivets, screws, clips or the like. A sheave 78 is mounted on the front side 20 of the column 12 below the winch 68, by means of mounting brackets 80 which support an axle on which the sheave 78 is mounted for rotation. The mounting brackets 80 are attached to the front side 20 of the column 12 by means of attachment members, which in this example are bolts 82, 84, which pass through mounting holes 86, 88 in the ribs 22, 24.

The positioning of the sheave 78 permits a winch cable 90 to be routed via a rear side of the sheave 78 to extend in a direction generally parallel to the jib 16, before passing over a sheave mounted within the frame 52 of the pulley system 18 and a further sheave 98 of the pulley system 18. This positioning of the sheave 78 and routing of the cable 90 ensures that the winch cable 90 cannot apply any compressive force which would urge the jib 16 to close, that is to say to move towards the column 12. Thus a load applied to the jib 16 is the dominant force in the system and there is no need for a rigid stay to prevent rotational movement of the jib 16 about the axle 36 under the influence of a load. Hence the flexible restraining strap 44 can be used instead of a rigid stay.

In some variants of the davit 10 the radius of the jib 16 may be adjustable when a load is being lifted by the davit 10 by means of a screw jack or hydraulic mechanism which is received in the channel defined by the fins 28, 30 of the rear side 26 of the column 12. In this variant the restraining strap 44 (which may alternatively be a restraining cable, for example) is received by or attached to the screw jack or hydraulic mechanism, which can be actuated to extend or retract the restraining strap 44 to increase or decrease the jib radius as required.

Figure 6:
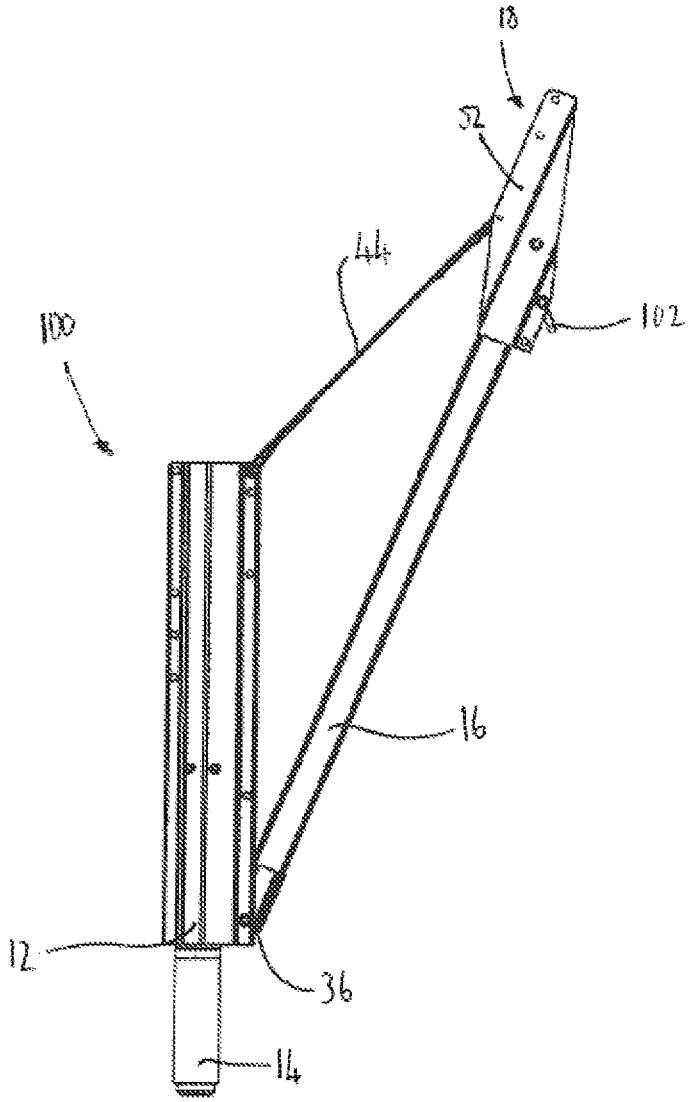
FIG. 6 is a view showing one side of an alternative embodiment of a davit.

FIG. 6 is a view from one side of an alternative embodiment of a davit, in which elements common to both this embodiment and the embodiments illustrated in FIGS. 1 to 5 have common reference numerals. In this embodiment, shown generally at 100, there is no winch, but a shackle 102 is provided at a distal end of the jib 16, to which a load to be moved can be attached. In davit 100 shown in FIG. 6 the restraining strap 44 is anchored to a pin which is retained in mounting holes which are provided towards upper ends of the ribs 22, 24.

Figure 7:
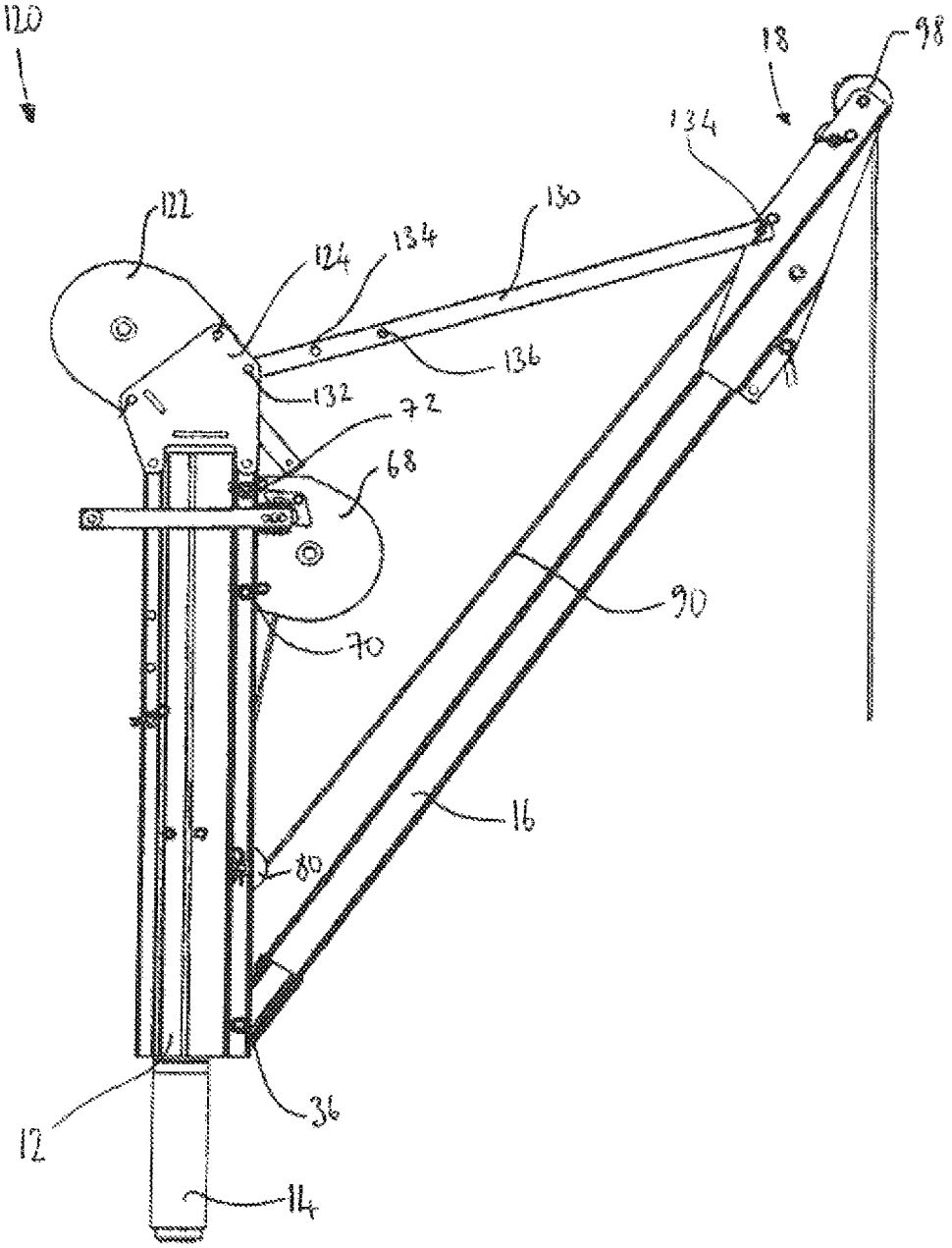
FIG. 7 is a view showing one side of a further alternative embodiment of a davit.

A further alternative embodiment of a davit is shown generally at 120 in FIG. 7. Again, elements common to the embodiment shown in FIG. 7 and the embodiments illustrated in FIGS. 1 to 5 have common reference numerals. In the davit 120 of FIG. 7 a second winch 122 is provided, and is mounted on a frame unit 124 which is provided at an upper end of the column 12. The second winch 122 is secured to the frame unit 124 by means of bolts or similar fastening means which pass through mounting holes in the frame unit 124 and through corresponding mounting holes in a housing of the second winch 122. The davit 120 illustrated in FIG. 7 employs a rigid stay 130 to prevent the jib 16 from opening or closing, that is to say moving away from or towards the column 12. The stay 130 is secured to the frame unit 124 by means of a bolt or other fastening means which passes through mounting holes 132 of the frame unit 124, and to the pulley system 18 by means of a bolt or other fastening member which passes through mounting holes 134 provided in a housing of the pulley system 18. The stay 130 also provides for adjustment of the radius of the jib 16 with respect to the column 12, as it is provided with alterative mounting holes 134, 136 by which the position at which the stay 130 is attached to the frame unit 124 can be adjusted.

Figure 8:
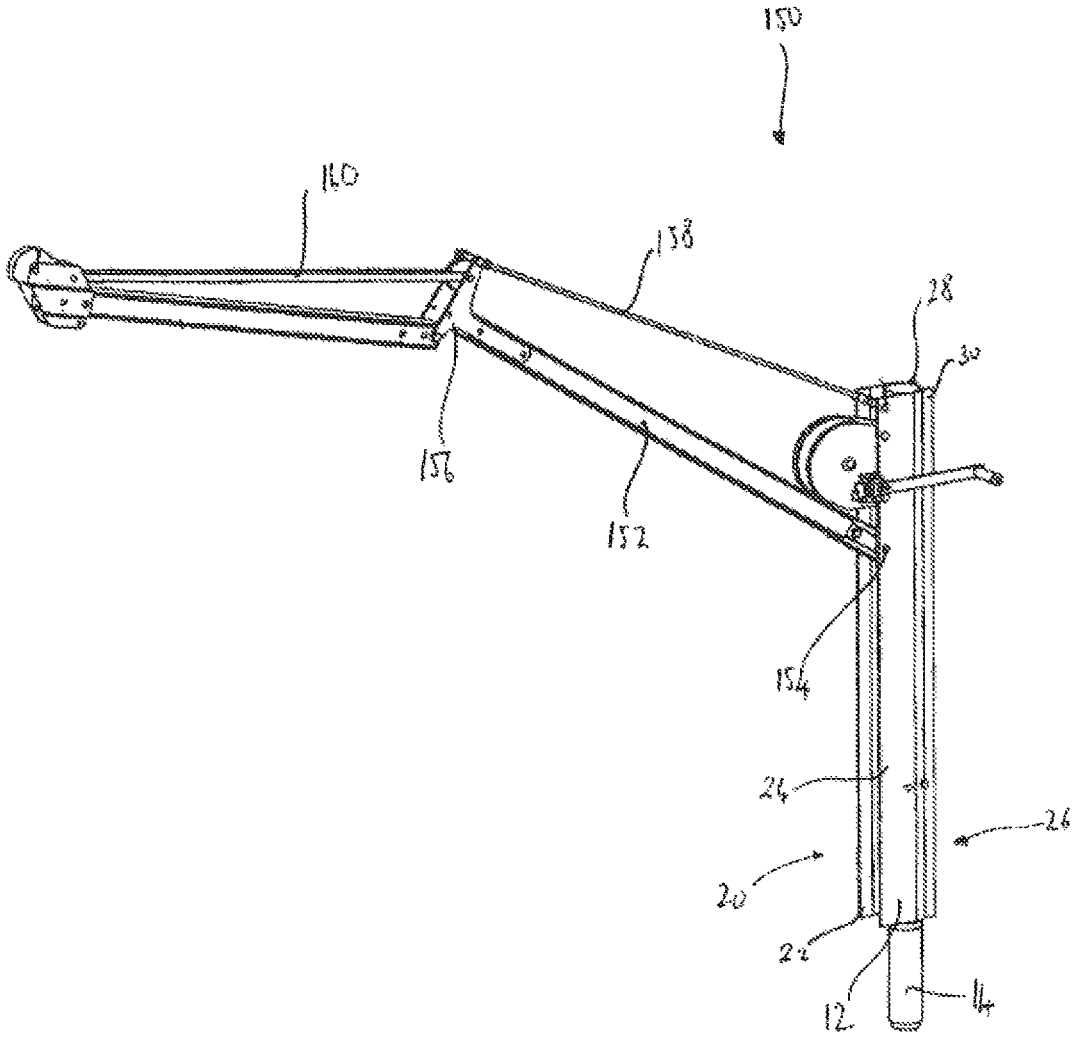
FIG. 8 is a perspective view showing a further alternative embodiment of a davit.

A further alternative embodiment of a davit is shown generally at 150 in FIG. 8. Again, elements common to the embodiment shown in FIG. 8 and the embodiments illustrated in FIGS. 1 to 5 have common reference numerals. The davit 150 illustrated in FIG. 8 has an extended jib 152 which is pivotally attached to the first side 20 of the column 12 by means of a pin or axle which is received in mounting holes 154 provided towards upper ends of the ribs 22, 24 of the front side 20 of the column 12. The extended jib 152 is provided with a folding knuckle joint 156 allowing the jib 152 to be folded for transport or storage purposes and extended for use. A stay 158, which may be a rigid stay or a flexible stay such as a strap or cable, is attached at one end thereof to the knuckle joint 156 and to the other end to the ribs 22, 24 of the first side 20 of the column 12 to prevent rotation of the jib 152 about the pin or axle 154. A further stay 160, which again may be a rigid stay or may be a flexible stay such as a strap or cable, is provided to prevent undesired rotary movement of a distal end of the extended jib 152. The stays 158, 160 are always in tension, which permits the use of either a rigid stay or a flexible stay.

The embodiment illustrated in FIG. 8 is provided with a winch and sheaves, but it will be appreciated that it could also be provided with shackles and a hoist, or with other tools to suit particular applications.

As will be appreciated from the foregoing description of the embodiments illustrated in FIGS. 1 to 8, the davit provides a lightweight and versatile solution which is suitable for use in a wide variety of lifting applications. The ribs 22, 24, 28, 30 of the column 12 add rigidity to the column 12 and provide an easy, quick and safe method of mounting tools and other equipment to the davit.

The invention claimed is:

1. A lifting tool comprising:

a column and a jib attached to the column, the column being configured for mounting for rotation about a longitudinal axis thereof, wherein the column is generally hollow, having a longitudinal bore extending therethrough, the longitudinal bore being configured to receive, in a base of the column, a substantially vertical post, and the column being formed with a first pair of parallel ribs, defining a longitudinal channel between them on a first side of the column, and with a second pair of parallel ribs, defining a longitudinal channel between them on a second side of the column, the second side of the column being generally opposed to the first side of the column, wherein the first and second pairs of parallel ribs are integral with the column and wherein the column is formed as a unitary body, wherein the column is provided with one or more attachment formations configured to attach a tool or other equipment to the first side of the column.

2. The lifting tool according to claim 1 wherein at least one of the ribs of the first pair is provided with one or more mounting holes for receiving attachment members for attaching the tool or other equipment to the ribs of the first side of the column.

3. A lifting tool comprising:

a column and a jib attached to the column, the column being configured for mounting for rotation about a longitudinal axis thereof, wherein the column is generally hollow, having a longitudinal bore extending therethrough, the longitudinal bore being configured to receive, in a base of the column, a substantially vertical post, and the column being formed with a first pair of parallel ribs, defining a longitudinal channel between them on a first side of the column, and with a second pair of parallel ribs, defining a longitudinal channel between them on a second side of the column, the second side of the column being generally opposed to the first side of the column, wherein the first and second pairs of parallel ribs are integral with the column and wherein the column is formed as a unitary body, wherein the column is provided with one or more attachment formations configured to attach a tool or other equipment to the second side of the column.

4. The lifting tool according to claim 3 wherein at least one of the ribs of the second pair is provided with one or more mounting holes for receiving attachment members for attaching the tool or other equipment to the ribs of the second side of the column.

5. A lifting tool comprising:

a column and a jib attached to the column, the column being configured for mounting for rotation about a longitudinal axis thereof, wherein the column is generally hollow, having a longitudinal bore extending therethrough, the longitudinal bore being configured to receive, in a base of the column, a substantially vertical post, and the column being formed with a first pair of parallel ribs, defining a longitudinal channel between them on a first side of the column, and with a second pair of parallel ribs, defining a longitudinal channel between them on a second side of the column, the second side of the column being generally opposed to the first side of the column, wherein the first and second pairs of parallel ribs are integral with the column and wherein the column is formed as a unitary body, wherein the column further comprises a bearing.

6. A lifting tool comprising:

a column and a jib attached to the column, the column being configured for mounting for rotation about a longitudinal axis thereof, wherein the column is generally hollow, having a longitudinal bore extending therethrough, the longitudinal bore being configured to receive, in a base of the column, a substantially vertical post, and the column being formed with a first pair of parallel ribs, defining a longitudinal channel between them on a first side of the column, and with a second pair of parallel ribs, defining a longitudinal channel between them on a second side of the column, the second side of the column being generally opposed to the first side of the column, wherein the first and second pairs of parallel ribs are integral with the column and wherein the column is formed as a unitary body, wherein the column is made of aluminum.

7. A lifting tool comprising:

a column and a jib attached to the column, the column being configured for mounting for rotation about a longitudinal axis thereof, wherein the column is generally hollow, having a longitudinal bore extending therethrough, the longitudinal bore being configured to receive, in a base of the column, a substantially vertical post, and the column being formed with a first pair of parallel ribs, defining a longitudinal channel between them on a first side of the column, and with a second pair of parallel ribs, defining a longitudinal channel between them on a second side of the column, the second side of the column being generally opposed to the first side of the column, wherein the first and second pairs of parallel ribs are integral with the column and wherein the column is formed as a unitary body, wherein the jib is pivotally attached to the column.

8. A lifting tool comprising:

a column and a jib attached to the column, the column being configured for mounting for rotation about a longitudinal axis thereof, wherein the column is generally hollow, having a longitudinal bore extending therethrough, the longitudinal bore being configured to receive, in a base of the column, a substantially vertical post, and the column being formed with a first pair of parallel ribs, defining a longitudinal channel between them on a first side of the column, and with a second pair of parallel ribs, defining a longitudinal channel between them on a second side of the column, the second side of the column being generally opposed to the first side of the column, wherein the first and second pairs of parallel ribs are integral with the column and wherein the column is formed as a unitary body, the lifting tool further comprising a pulley, wherein the pulley is mounted at a distal end of the jib and wherein the jib is pivotally attached to the column at a proximal end of the jib, the lifting tool further comprising a stay disposed above the jib and configured to adjust the position of the pulley, wherein the stay includes a distal end connected to the pulley and includes a proximal end coupled to one or more mounting holes in the ribs of the column, wherein the stay is a flexible strap and wherein the strap is supported by a spool mounted at an upper end of the column.

* * * * *